US008337009B2

(12) United States Patent
Roof et al.

(10) Patent No.: US 8,337,009 B2
(45) Date of Patent: Dec. 25, 2012

(54) METHOD FOR SKEWING PRINTER TRANSFIX ROLL

(75) Inventors: Bryan James Roof, Newark, NY (US); Laurence Lynd, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 952 days.

(21) Appl. No.: 12/406,351

(22) Filed: Mar. 18, 2009

(65) Prior Publication Data

US 2010/0236438 A1 Sep. 23, 2010

(51) Int. Cl.
*B41J 2/01* (2006.01)

(52) U.S. Cl. ..... 347/103; 347/88; 101/375

(58) Field of Classification Search ..... 347/104, 347/103, 101, 88, 99; 101/486, 375
See application file for complete search history.

(56) References Cited

U.S. PATENT DOCUMENTS

| | | | | |
|---|---|---|---|---|
| 7,325,917 | B2 | 2/2008 | Kohne et al. | |
| 2006/0250467 | A1 * | 11/2006 | Folkins | 347/103 |
| 2007/0024668 | A1 * | 2/2007 | Folkins | 347/103 |
| 2007/0076080 | A1 * | 4/2007 | Knierim et al. | 347/103 |
| 2007/0084366 | A1 * | 4/2007 | Costanza et al. | 101/375 |
| 2007/0188576 | A1 * | 8/2007 | Snyder et al. | 347/103 |

* cited by examiner

*Primary Examiner* — Manish S Shah
(74) *Attorney, Agent, or Firm* — Maginot, Moore & Beck, LLP

(57) ABSTRACT

A method of forming a nip with a skewed transfix roll includes positioning a first axis of rotation of a transfix roll at a skewed angle with respect to a second axis of rotation of an image drum, forming a nip with the skewed transfix roll and the image drum, and operating the printer with the nip formed with the skewed transfix roll.

19 Claims, 5 Drawing Sheets

METHOD FOR SKEWING PRINTER TRANSFIX ROLL

TECHNICAL FIELD

The method disclosed herein relates to printers and more particularly to printers incorporating a transfix roll.

BACKGROUND

The word "printer" as used herein encompasses any apparatus, such as a digital copier, book marking machine, facsimile machine, multi-function machine, etc., which performs a print outputting function for any purpose. Printers using intermediate transfer, transfix, or transfuse members are well known. In general, such printing systems typically include a printing or imaging member in combination with a printhead which is used to form an image on the imaging member. A final receiving surface or print medium is brought into contact with the imaging surface after the image has been placed thereon by the nozzles of the printhead. The image is then transferred and fixed to the print medium by the imaging member in combination with a transfix pressure member, or in other embodiments, by a separate fuser and pressure member.

Some printer systems which incorporate intermediate transfix members also incorporate a phase change ink. In one such printer system, the imaging process begins by applying a thin liquid, such as, for example, silicone oil, to an imaging member surface. The solid or hot melt ink is placed into a heated reservoir where it is melted into a liquid state. The highly engineered hot melt ink is formulated to meet a number of constraints, including low viscosity at jetting temperatures, specific visco-elastic properties at component-to-media transfer temperatures, and high durability at room temperatures.

The heated reservoir provides the liquefied ink to an associated printhead. Once within the printhead, the liquid ink flows through manifolds and is ejected from microscopic orifices through use of proprietary piezoelectric transducer (PZT) printhead technology. The duration and amplitude of the electrical pulse applied to the PZT is very accurately controlled so that a repeatable and precise pressure pulse can be applied to the ink resulting in the proper volume, velocity, and trajectory of the droplet. Several rows of jets, for example four rows, can be used, each one with a different color. The individual droplets of ink are jetted onto the liquid layer on the imaging member. The imaging member and liquid layer are held at a specific temperature at which the ink hardens to a ductile visco-elastic state.

In conjunction with forming the image on the imaging drum, a print medium is heated by feeding it through a preheater and into a nip formed between the imaging member and a pressure member, either or both of which can also be heated. The nip is maintained at a high pressure by forcing a high durometer synthetic transfix pressure member against the imaging member. As the imaging member rotates, the heated print medium is pulled into and through the nip and is pressed against the deposited ink image by the opposing surfaces of the transfix pressure member and the image member.

The high pressure conditions within the nip compresses the print medium and ink together, spreads the ink droplets, and fuses the ink droplets to the print medium. Heat from the preheated print medium heats the ink in the nip, making the ink sufficiently soft and tacky to adhere to the print medium.

When the print medium leaves the nip, stripper fingers or other like members peel it from the printer member and direct it into a media exit path.

To optimize image resolution, the conditions within the nip must be carefully controlled. The transferred ink drops should spread out to cover a specific area to preserve image resolution. Too little spreading leaves gaps between the ink drops while too much spreading results in intermingling of the ink drops. Additionally, the nip conditions must be controlled to maximize the transfer of ink drops from the image member to the print medium without compromising the spread of the ink drops on the print medium. Moreover, the ink drops should be pressed into the paper with sufficient pressure to prevent their inadvertent removal by abrasion thereby optimizing printed image durability. Thus, the temperature and pressure conditions must be carefully controlled and must be consistent over the entire area of the nip.

The necessary pressure and temperature within the nip are a function not only of the particular ink, but also of the rate at which images are transferred from the imaging member to the print medium. In other words, spreading and transfer of ink is a function not only of the pressure and temperature conditions within the nip, but also of the duration that the ink is within the nip. Thus, as the process speed is increased, one or more of the pressure within the nip, the temperature within the nip, and the nip width (the in-process dimension of the nip) must increase to provide desired image quality.

The nip width is a function of the diameters of the image member and the transfix member. Thus, increased process speed is enabled by increased image member and transfix member diameter. Increasing the diameter of the image member and the transfix member, however, requires a larger frame. Nip width can also be increased, without increasing the diameter of the image member and the transfix member, by increasing the pressure within the nip thereby flattening the surfaces of the rolls within the nip. Accordingly, the applied load on the transfix pressure member in certain printer systems is increased from 1,100 pounds up to about 4,000 pounds to provide consistent image quality at increased speeds.

Accordingly, in order to achieve the uniform high pressures needed for high speed imaging, particular attention must be given to the manner in which the transfix pressure roller is manufactured. By way of example, force is applied to the imaging member and the transfix pressure roller at the outer edges of the rollers. Consequently, application of the high pressures needed for high speed imaging results in deformation of the transfix roll with the end portions of the transfix roll positioned closer to the axis of rotation of the image drum than the center portion of the transfix roll. The deformation of the transfix roll caused by application of force only at the outer ends of the transfix roll results in an undesired pressure profile for a transfix roll with a flat profile in the cross-process direction wherein the pressures at the outer edges of the process path are higher than the pressure in the middle portion of the process path. One approach to correcting this issue is to form a transfix roll with a crowned profile.

A "crowned profile" is a profile wherein the diameter of the transfix roll at the middle of the process path is larger than the diameter of the transfix roll at the outer portions of the process path. Transfix rolls with crowned profiles provide a desired image quality, roll life, and acceptable cost. Optimal performance of the crowned transfix pressure component, however, is achieved by adhering to carefully controlled manufacturing tolerances of small magnitude.

SUMMARY

A method of forming a nip with a skewed transfix roll includes positioning a first axis of rotation of a transfix roll at a skewed angle with respect to a second axis of rotation of an image drum, forming a nip with the skewed transfix roll and the image drum, and operating the printer with the nip formed with the skewed transfix roll.

In accordance with another embodiment, a method of operating a printer includes identifying a cross-process profile of a transfix roll, calculating a skew angle based upon the identified cross-process profile, positioning a first axis of rotation of the transfix roll at the calculated skew angle with respect to a second axis of rotation of the image drum, and operating the printer with the first axis of rotation skewed with respect to the second axis of rotation.

In a further embodiment, a method of improving a nip profile of a printer includes forming a nip with a transfix roll and an image drum, positioning a first axis of rotation of the transfix roll in a first orientation with respect to a second axis of rotation of the image drum, identifying a characteristic of the nip, and positioning the first axis of rotation in a second orientation with respect to the second axis of rotation based upon the identified characteristic, wherein the minimum distance from the second axis of rotation to a first end portion of the transfix roll at the second orientation is greater than the minimum distance from the second axis of rotation to the first end portion at the first orientation, and the nip profile with the first end portion at the second orientation is more uniform than the nip profile with the first end portion at the first orientation.

DESCRIPTION

Figure 1:
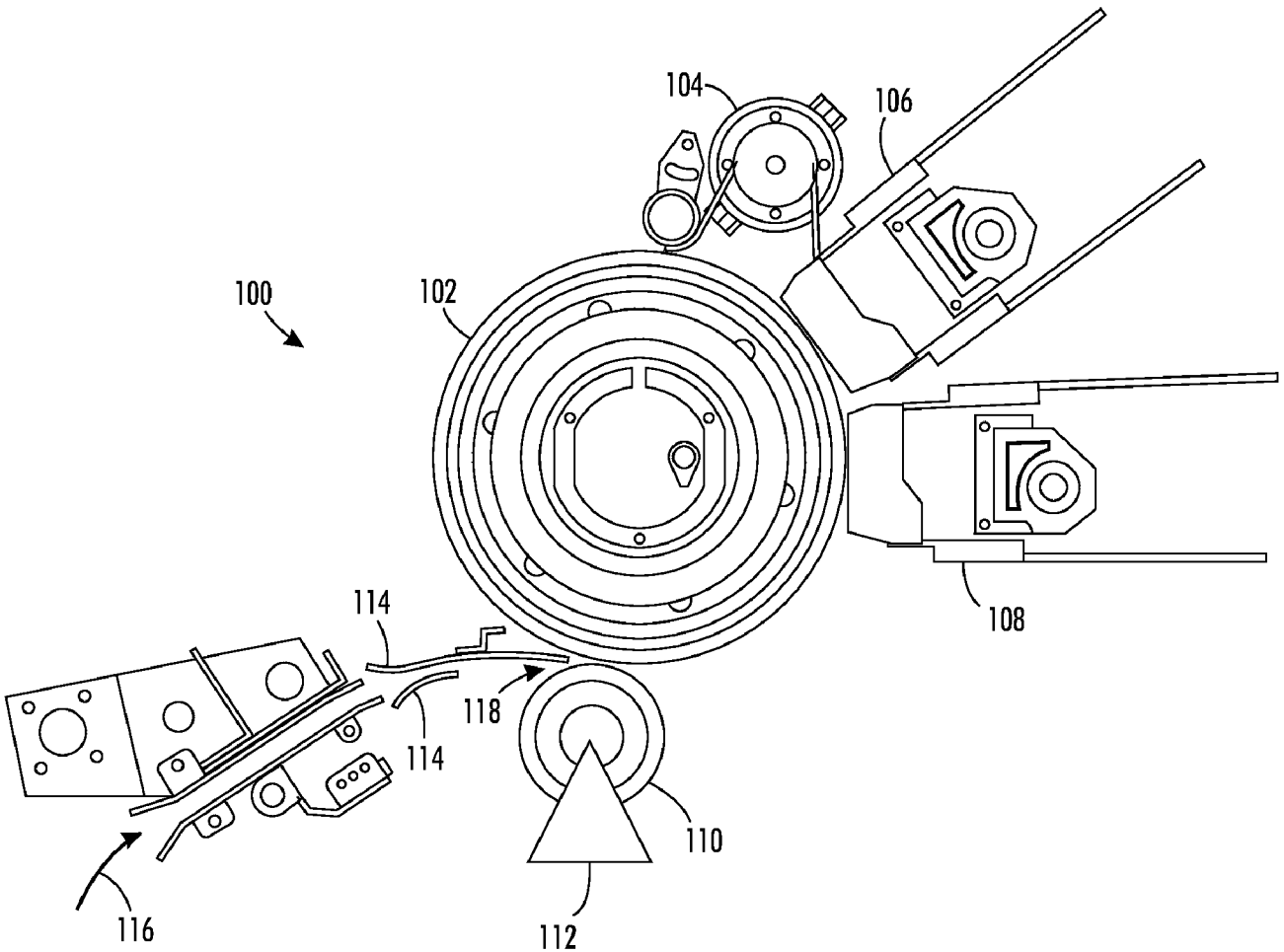
FIG. 1 depicts a simplified side plan view of a printer with a transfix roll adjacent to an image drum and forming a nip.

With initial reference to FIG. 1, a printer 100 includes a cylindrical image drum 102 which is driven by a motor 104. Two printheads 106 and 108 are positioned to transfer ink to the printer image drum 102. While two printheads 106 and 108 are shown, more or fewer printheads may be incorporated into a particular system.

A transfix roll 110 is maintained in position against the image drum 102 by a transfix roll support 112. Guides 114 direct print media travelling along a process path 116 of the printer 100 into the nip 118 formed by the contact between the transfix roll 110 and the image drum 102.

The transfix roll support 112 is configured to position the transfix roll 110 at a desired orientation with respect to the image drum 102 and to generate a desired pressure within the nip 118. The transfix roll 110 has a crowned profile wherein the diameter of the transfix roll at the middle of the process path 116 is larger than the diameter of the transfix roll 110 at the outer portions of the process path 116. When the transfix roll 110 is positioned against the image drum 102, the nip 118 is formed with characteristics described with reference to FIG. 2.

Figure 2:
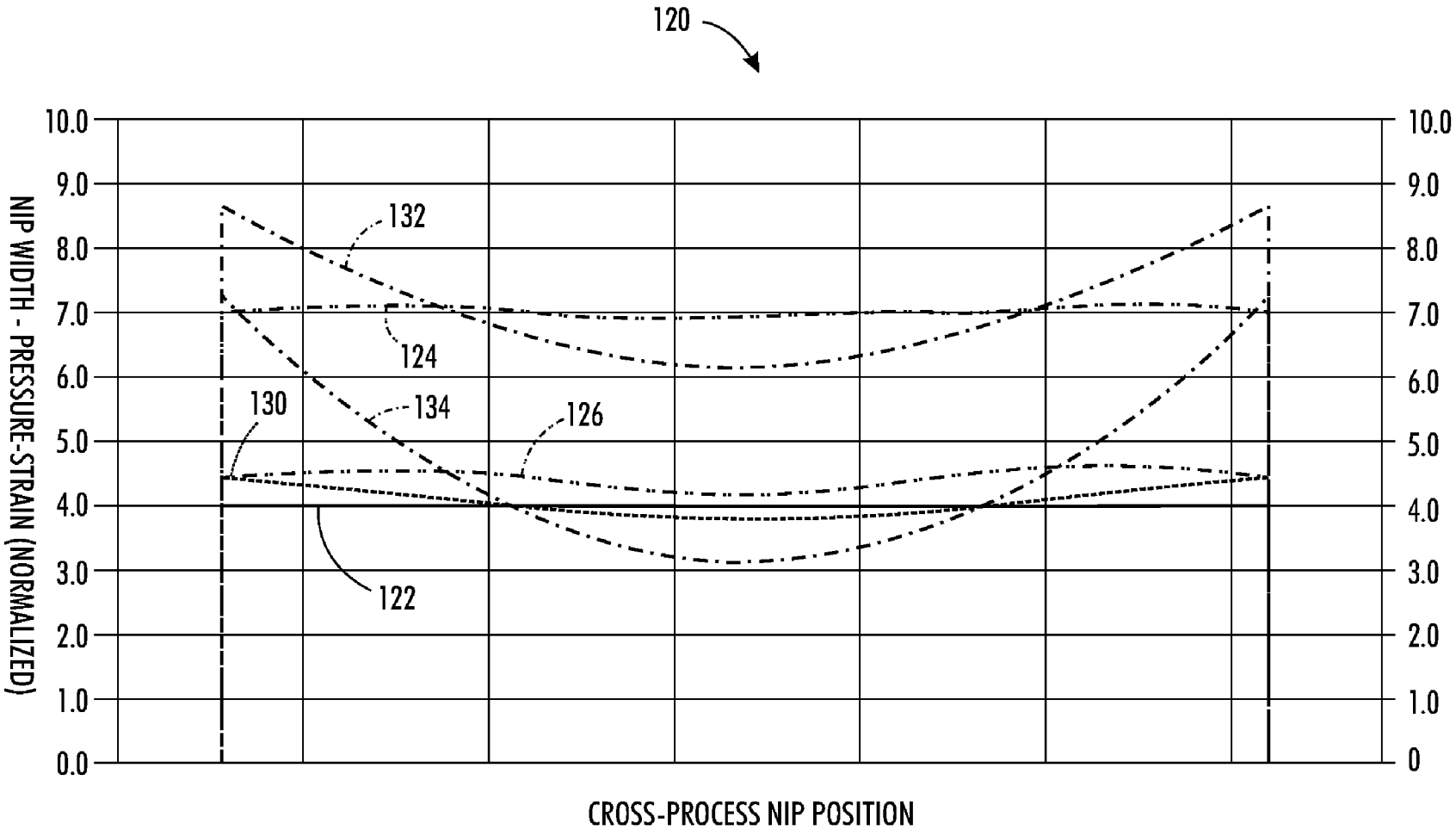
FIG. 2 depicts a graph of different characteristics of two different nip profiles.

FIG. 2 depicts a graph 120 of different normalized characteristics of the nip 118 and the transfix roll 110. The line 122 of the graph 120 reflects the width of the nip 118 formed by pressing the crowned transfix roll against the image drum 102. A nip "width" is the distance along an in-process axis of the process path 116 over which the transfix roll 110 is in contact with the image drum 102. A nip "length" is the distance along a cross-process axis of the process path 116 over which the transfix roll 110 is in contact with the image drum 102. The line 122 indicates that the nip width formed using the crowned transfix roll is very uniform at about 4 with a variance of about 0.1 (2.5%) along the length of the nip 118. A uniform nip width reduces the potential for deformation of a print media as the print media is drawn through the nip 118.

The line 124 of the graph 120 depicts the normalized pressure within the nip 118 generated by pressing the transfix roll 110 against the image drum 102. The line 124 is relatively constant at about 7 with a variance of about 0.23 (3.3%) across the entire length of the nip 118. Accordingly, the transfer of ink from the image drum 102 to print media travelling along the process path 116 would not be significantly adversely affected by the pressure variations along the length of the nip 118.

The line 126 of the graph 120 depicts the strain energy generated at the layer interface between adjacent layers of the transfix roll 110. The line 126 indicates a relatively uniform strain of about 4.4 with a peak of about 4.64 (105%) and a variance of about 0.4 (9%) across the entire width of the nip 118. Accordingly, the material bonds within the transfix roll 110 are not overstressed.

Difficulties in achieving the nip characteristics shown in FIG. 2 arise, however, because even slight changes in the profile of the transfix roll 110 result in significant changes in the nip profile. By way of example, flattening the profile of the transfix roll 110 by 30 microns results in the nip characteristics depicted by the line 130, 132, and 134 in FIG. 2.

The line 130 of the graph 120 depicts the width of the nip 118 formed by pressing the transfix roll 110 with the flattened profile against the image drum 102. The line 130 indicates that the nip width formed using the flattened transfix roll 110 varies by about 0.7 (17.5% of the nip width indicated by line 130) along the length of the nip 118. Thus, the 30 micron difference between the profile used to generate the line 122 and the profile used to generate the line 130 significantly increases the nip width variation along the nip 118. This significant increase in nip width variation substantially increases the potential for deformation of a print media as the print media is drawn through the nip 118.

The line 132 of the graph 120 depicts the pressure within the nip 118 generated by pressing the transfix roll 110 with the flattened profile against the image drum 102. The line 132 shows a peak pressure of about 8.6 with a large variance of over 2.4 (about 34% of the pressure indicated with the line 124) across the entire length of the nip 118. Thus, the 30 micron difference between the profile used to generate the line 124 and the profile used to generate the line 132 significantly increases the pressure variation along the nip 118. Accordingly, the transfer of ink from the image drum 102 to print media travelling along the process path 116 would be adversely affected by pressure variations along the length of the nip 118 formed with the flattened profile.

The line 134 of the graph 120 depicts the strain energy generated at the layer interface between adjacent layers of the transfix roll 110 with the flattened profile. The line 134 shows a large variance of about 4 (90% of the strain indicated with the line 126) across the entire width of the nip 118 with a peak strain of about 7 (175% of the strain indicated with the line 126). Accordingly, the 30 micron difference between the profile used to generate the line 126 and the profile used to generate the line 134 significantly increases both the maximum strain and the strain variation within the transfix roll 110. Thus, the potential for shortening the life of the transfix roll 110 by overstressing material bonds between adjacent layers in the transfix roll 110 is significantly increased.

Figure 3:
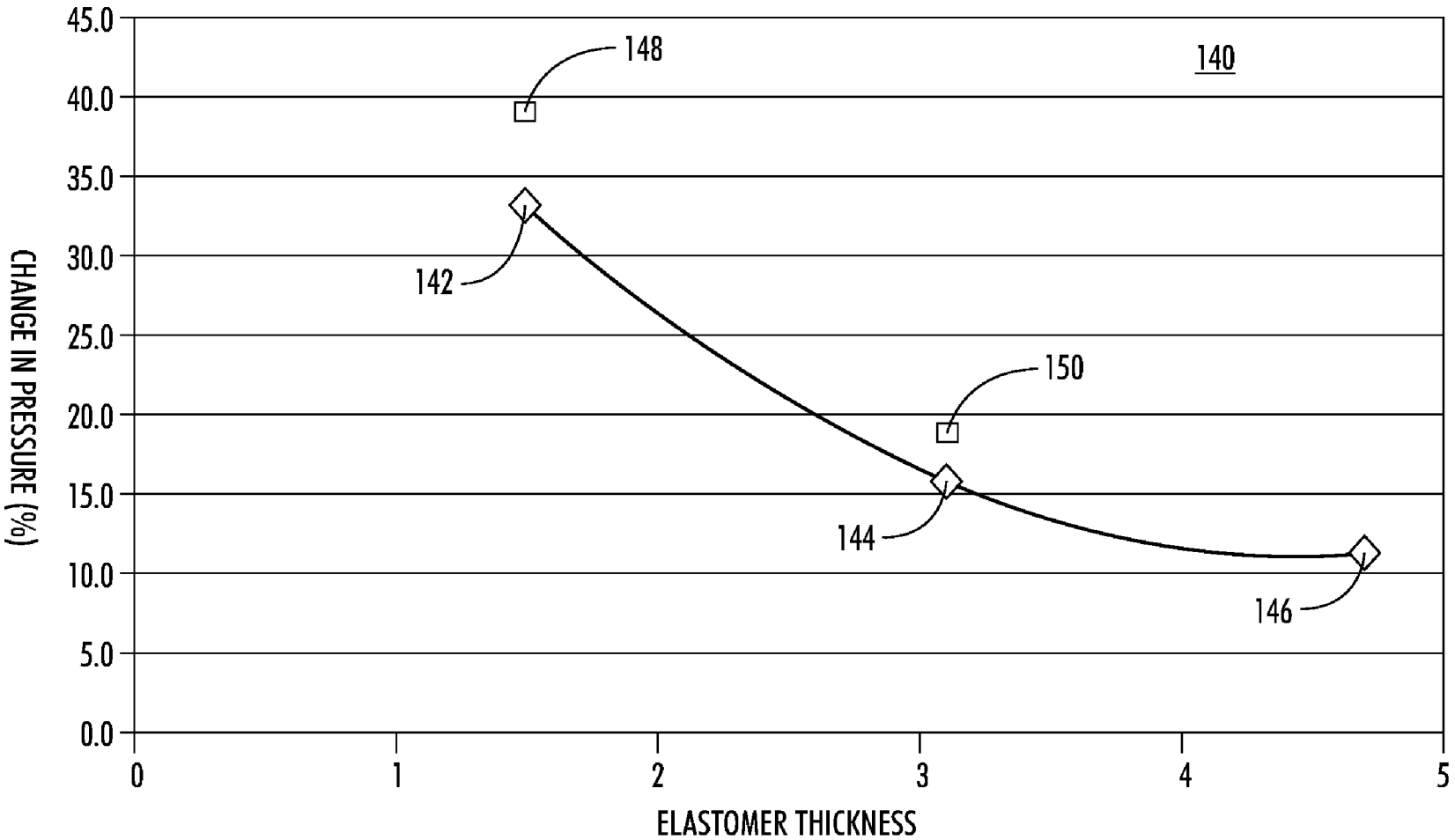
FIG. 3 depicts a graph of the effect of a change in crown profile of a transfix roll on the pressure within a nip for transfix rolls formed with different hardnesses.

The variance in pressure across the length of the nip 118 may be ameliorated by changing the surface characteristics of the transfix roll 110. The chart 140 of FIG. 3, for example, depicts the effects of a 30 micron change in profile on the pressure achieved within a nip. The data points 142, 144, and 146 were obtained using an elastomer with a 60 D durometer hardness formed with a layer thickness of about 1.5 mm, about 3.1 mm, and about 4.6 mm, respectively. A 30 micron change in the profile for the transfix roll 110 incorporating the layer thicknesses of about 1.5 mm, about 3.1 mm, and about 4.6 mm resulted in pressure changes of about 32.5%, about 11.4%, and about 15.5%, respectively. Thus, increased layer thickness of the transfix roll 110 reduces pressure variances. Moreover, increased layer thickness reduces strain energy generated between adjacent layers.

The data points 148 and 150 were obtained using an elastomer with a 70 D durometer hardness formed with a layer thickness of about 1.5 mm, and about 3.1 mm, respectively. A 30 micron change in the profile for the transfix roll 110 incorporating the layer thicknesses of about 1.5 mm, about 3.1 mm, resulted in pressure changes of about 38.9% and 18.6%, respectively. For the corresponding thickness with a softer material (data points 142 and 144), the change was about 32.5%, and about 11.4%, respectively. Thus, increased material softness in the layer material of the transfix roll 110 reduces pressure variances. As material softness is reduced, however, strain energy generated between adjacent layers increases.

Accordingly, optimizing material hardness for reduction of pressure variations increases the potential for elastomer failure. Increased pressure uniformity and longer roll life can, however, be achieved by incorporating thicker layers of material a transfix roll 110. As layer thickness is increased, however, achieving the high pressures necessary for high speed imaging becomes more difficult. For example, larger components may be needed. Thus, the potential for optimizing nip characteristics and transfix roller lifetime using only layer modification and material hardness modification is limited. Nip profile characteristics in the printer 100, however, can be modified without requiring modification of the layer thickness or material hardness of the transfix roll 110.

Specifically, the transfix roll support 112 is configured to allow the transfix roll 110 to be selectively skewed with respect to the image drum 102. Skewing of the transfix roll 110 may be accomplished in any desired manner. For example, the transfix roll support 112 may incorporate a pivot and lock system whereby the desired skew angle is established and the transfix roll support locked. In a further embodiment, each end of the transfix roll support 112 may be independently movable along the in-process direction, thereby allowing the distance between each of the end portions of the transfix roll 110 and the axis of rotation of the image drum 102 to be changed.

In an exemplary case, a force of 2500 pounds was established between an image drum and a transfix roll with a flat profile along the length of the transfix roll. The transfix roll was then pivoted while maintaining a 2500 pound force on the system. The results are depicted in FIG. 4 wherein the line 162 identifies the offset between the opposite ends of the transfix roll along the in-process direction and the line 164 identifies the nip width at the ends of the transfix roll.

Figure 4:
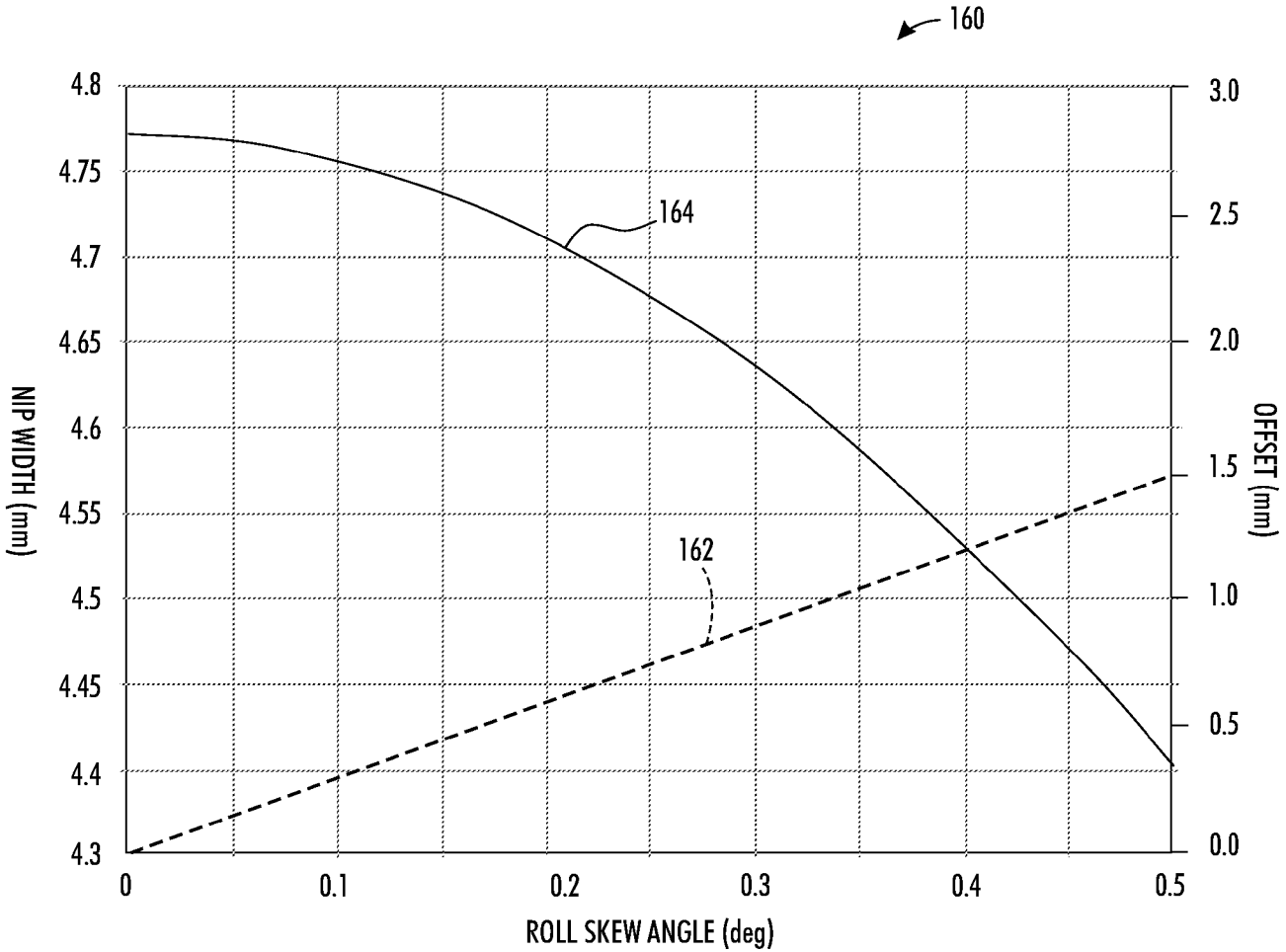
FIG. 4 depicts a graph of the effect on nip width as a transfix roll is positioned with different amounts of skew with respect to an image drum.

FIG. 4 reveals that when the axis of rotation of the transfix roll is aligned parallel with the axis of rotation of the image drum (0 degrees skew), the nip width at the ends of the transfix roll is about 4.77 mm. The nip width at the middle of the transfix roll was determined to be 3.0 mm. As the transfix roll was pivoted, the nip width at the outer edges of the transfix roll decreased. In this example, the pivot axis is located at the middle of the transfix roll. Thus, both end portions of the transfix roll move away from the axis of rotation of the image drum at the same rate.

Accordingly, at 0.5 degrees of skew, or 1.5 mm of offset for both end portions of the transfix roll, the nip width at the edges of the transfix roll decreased to just over 4.4 mm. Therefore, since the nip width at the outer portions of the transfix roll decreased, as did the overall nip length, the width of the nip at the center of the transfix roll necessarily increased above 3 mm.

The results of the foregoing example show that skewing of a transfix roll with respect to an image roll can be used to modify the pressure profile and nip width within a nip. The extents of the changes that can be effected depend upon the elastomer thickness and hardness for a particular transfix roll.

Figure 5:
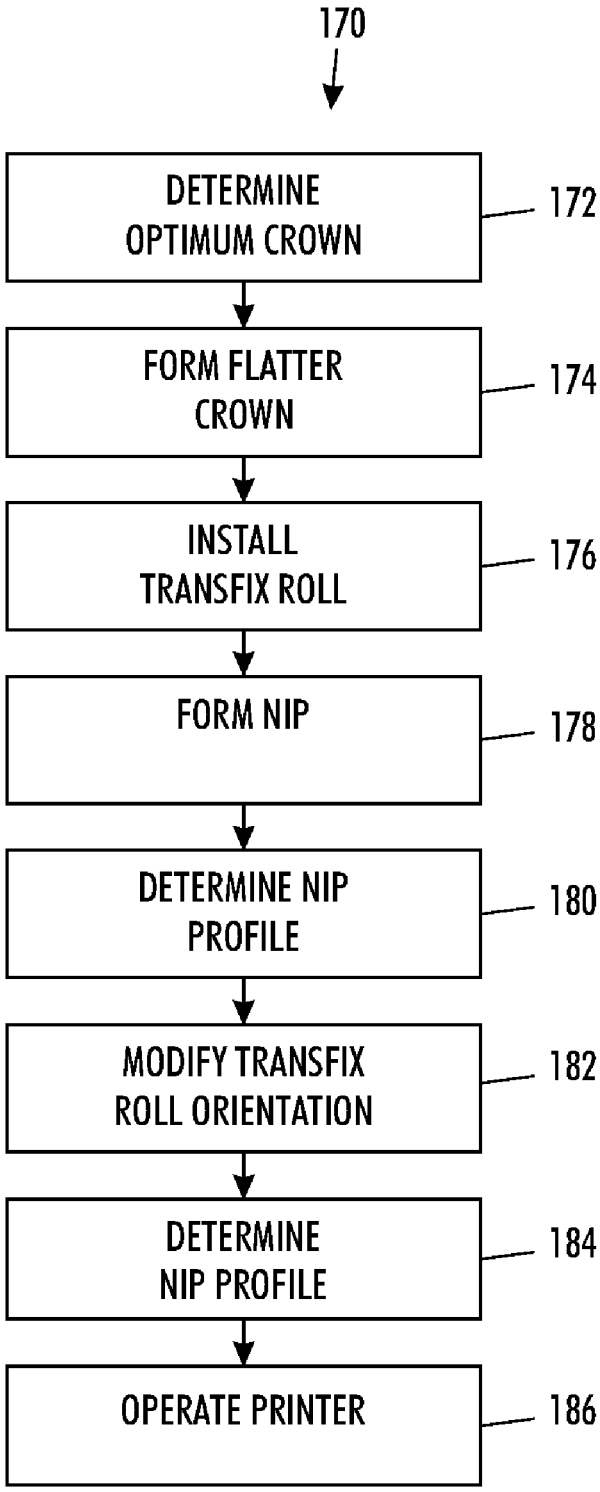
FIG. 5 depicts a procedure for skewing a transfix roll with respect to an image roll to modify nip characteristics in a nip formed by the transfix roll and the image roll.

FIG. 5 depicts a procedure 170 for skewing a transfix roll to modify nip profile characteristics. Initially, a crown profile for a transfix roll is determined such that the transfix roll and image drum form a nip with a desired nip profile when the axis of rotation of the transfix roll is parallel with the axis of rotation of the image drum (block 172). One such nip profile may exhibit a nip width, pressure, and strain energy similar to the nip width line 122, the pressure line 124, and the strain energy line 126.

The transfix roll is then formed using manufacturing specifications directed to manufacturing a crown profile that is flatter than the determined crown profile (block 174). The difference between the manufacturing specifications and the crown profile determined at block 172 is selected to insure that the crown profile of the finished product will be at the design crown profile or flatter than the design crown profile by accounting for accuracy limitations in the manufacturing process. This ensures that a uniform pressure can be generated in a nip as described below.

The formed transfix roll is then installed into a printer device at location adjacent to an image drum (block 176). In one embodiment, the transfix roll may be initially installed such that the axis of rotation of the transfix roll is not parallel with the axis of rotation of the image drum. For example, the actual cross-process profile of a transfix roll can be accurately measured and used to calculate an estimated skew correction. The estimated skew correction may then be used to guide the initial installation. In another embodiment, the transfix roll is positioned with the axis of rotation of the transfix roll substantially parallel with the axis of rotation of the image drum.

Once the transfix roll is positioned, a nip is formed (block 178) by forcing the transfix roll and the image drum together at the pressure desired for operation of the printer. One or more nip characteristics (i.e., nip width or nip pressure) are then obtained (block 180). In one embodiment, the nip width is determined for both end portions of the roll and the center portion of the roll. Any variances in nip width can be reduced by selective skewing of the transfix roll. Alternatively, if a generic nip profile is available, the nip width at a single location along the transfix roll can be obtained to determine the nip profile along the entire transfix roll.

Once a skew correction is determined, the orientation of the transfix roll with respect to the image drum is modified (block 182). Pivoting of the transfix roll may be accomplished with a pivot axis located at any position along the axis of rotation of the transfix roll. Accordingly, in one embodiment the pivot axis is located at about the center of the process path. In another embodiment, the end portions of the transfix roll are separately positionable such that the pivot axis may be selected by the user to be at any location along the axis of rotation of the transfix roll.

The nip profile is then determined for the modified orientation (block 184) by obtaining one or more nip profile characteristics. If the nip width at the end of the roll is wider or narrower than the nip width at the end of the nip for the desired nip profile, the user may continue to pivot the transfix roll until the desired nip profile is realized. The printer is then placed into operation with the transfix roll in the skewed position relative to the image drum (block 186).

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art, which are also intended to be encompassed by the following claims.

What is claimed is:

1. A method of forming a nip with a skewed transfix roll comprising:

positioning a first axis of rotation of a transfix roll at a skewed angle in a first orientation with respect to second axis of rotation of an image drum;

identifying a nip characteristic at the first orientation;

changing the orientation of the first axis of rotation from the first orientation to a second orientation with respect to the second axis of rotation based upon the identified nip characteristic;

forming a nip with the skewed transfix roll and the image drum; and operating the printer with the nip formed with the skewed transfix roll.

2. The method of claim 1, the positioning of the first axis of rotation further comprising:

identifying the nip characteristic at the second orientation.

3. The method of claim 1, the changing of the orientation further comprising:

moving a first end portion of the transfix roll from a first location to a second location, wherein the minimum distance from the second axis of rotation to the second location is greater than the minimum distance from the second axis of rotation to the first location.

4. The method of claim 3, the changing of the orientation further comprising:

moving a second end portion of the transfix roll from a third location to a fourth location, wherein the minimum distance from the second axis of rotation to the fourth location is greater than the minimum distance from the second axis of rotation to the third location.

5. The method of claim 1, wherein the skew of the first axis of rotation with respect to the second axis of rotation is larger at the second orientation than at the first orientation.

6. The method of claim 5, wherein the first axis of rotation is substantially parallel to the second axis of rotation at the first orientation.

7. The method of claim 1, the identifying of a nip characteristic at the first orientation further comprising:

measuring a nip width at a first end portion of the transfix roll;

measuring a nip width at a second end portion of the transfix roll; and measuring a nip width at a center portion of the transfix roll.

8. The method of claim 1, the positioning of a first axis of rotation of a transfix roll at a skewed angle further comprising:

identifying a cross-process profile of the transfix roll;

calculating a skew angle based upon the identified cross-process profile; and positioning the first axis of rotation at the calculated skewed angle.

9. A method of operating a printer, comprising:

identifying a cross-process profile of a transfix roll;

calculating a skew angle based upon the identified cross-process profile;

positioning a first axis of rotation of the transfix roll at the calculated skew angle with respect to a second axis of rotation of the image drum; and operating the printer with the first axis of rotation skewed with respect to the second axis of rotation.

10. The method of claim 9, further comprising:

identifying a characteristic of the nip at the calculated skew angle; and changing the orientation of the first axis of rotation from the calculated skew angle to a second orientation with respect to the second axis of rotation based upon the identified characteristic.

11. The method of claim 9, the identifying of a cross-process profile further comprising:

measuring a plurality of diameters of the transfix roll.

12. The method of claim 11, the measuring of a plurality of diameters further comprising:

measuring a first of the plurality of diameters of the transfix roll at a first end portion of the transfix roll;

measuring a second of the plurality of diameters of the transfix roll at a second end portion of the transfix roll; and measuring a third of the plurality of diameters of the transfix roll at a center portion of the transfix roll.

13. A method of modifying a nip profile of a printer, comprising:

forming a nip with a transfix roll and an image drum;

positioning a first axis of rotation of the transfix roll in a first orientation with respect to a second axis of rotation of the image drum;

identifying a characteristic of the nip; and positioning the first axis of rotation in a second orientation with respect to the second axis of rotation based upon the identified characteristic, wherein the minimum distance from the second axis of rotation to a first end portion of the transfix roll at the second orientation is greater than the minimum distance from the second axis of rotation to the first end portion at the first orientation, and the nip profile with the first end portion at the second orientation is more uniform than the nip profile with the first end portion at the first orientation.

14. The method of claim 13, wherein identifying the characteristic of the nip is performed a first time with the first end portion at the first orientation and a second time with the first end portion at the second orientation.

15. The method of claim 13, wherein the minimum distance from the second axis of rotation to a second end portion of the transfix roll at the second orientation is greater than the minimum distance from the second axis of rotation to the second end portion at the first orientation.

16. The method of claim 13, the identifying of a characteristic of the nip further comprising:

measuring a width of the nip at the first end portion of the transfix roll.

17. The method of claim 16, the identifying of a characteristic of the nip further comprising:

measuring a width of the nip at a second end portion of the transfix roll.

18. The method of claim 17, the identifying of a characteristic of the nip further comprising:

measuring a width of the nip at a center portion of the transfix roll.

19. The method of claim 13, wherein the first axis of rotation is substantially parallel to the second axis of rotation at the first orientation.

* * * * *